US005907274A

United States Patent [19]

Kimura et al.

[11] Patent Number: 5,907,274

[45] Date of Patent: May 25, 1999

[54] CHIP RESISTOR

[75] Inventors: Suzushi Kimura; Koji Shimoyama; Naotugu Yoneda; Keiichi Nakao, all of Osaka, Japan

[73] Assignee: Matsushita Electric Industrial Co., Ltd., Osaka, Japan

[21] Appl. No.: 08/923,703

[22] Filed: Sep. 4, 1997

[30] Foreign Application Priority Data

Sep. 11, 1996 [JP] Japan ..... 8-240294

[51] Int. Cl.[6] ..... H01C 1/012

[52] U.S. Cl. ..... 338/309; 338/308; 338/332

[58] Field of Search ..... 338/309, 308, 338/306, 332

[56] References Cited

U.S. PATENT DOCUMENTS

| | | | |
|---|---|---|---|
| 4,437,140 | 3/1984 | Ohyama et al. | 361/402 |
| 4,684,916 | 8/1987 | Ozawa | 338/308 |
| 5,510,594 | 4/1996 | Mori et al. | 219/121.69 |
| 5,680,092 | 10/1997 | Yamada et al. | 338/309 |

OTHER PUBLICATIONS

Patent Abstracts of Japan, vol. 013, No. 207 (E–750), May 16, 1989 & JP 01 024401 A (Murata Mfg Co Ltd), Jan. 26, 1989, * abstract *.

Patent Abstracts of Japan, vol. 013, No. 410 (E–819), Sep. 11, 1989 & JP 01 151205 A (Matsushita Electric Ind Co Ltd), Jun. 14, 1989, * abstract *.

Patent Abstracts of Japan, vol. 016, No. 174 (E–1195), Apr. 27, 1992 & JP 04 018701 A (Murata Mfg Co Ltd), Jan. 22, 1992, * abstract *.

Patent Abstracts of Japan, vol. 097, No. 001, Jan. 31, 1997 & JP 08 236325 A (Hokuriku Electric Ind Co Ltd), Sep. 13, 1996, * abstract *.

Patent Abstracts of Japan, vol. 007, No. 251 (E–209), Nov. 8, 1983 & JP 58 138071 A (Matsushita Denki Sangyo KK), Aug. 16, 1983, * abstract *.

*Primary Examiner*—Michael L. Gellner
*Assistant Examiner*—Richard K. Lee
*Attorney, Agent, or Firm*—Pearne, Gordon, McCoy & Granger LLP

[57] ABSTRACT

The invention relates to a chip resistor which is used as a circuit part for various electric apparatuses. The object of the invention is to realize a low resistance and a low TCR, and also high accuracy and high reliability. In order to achieve the object, a chip resistor is configured so as to have: a substrate; a resistance layer which is formed on at least one face of the substrate and which is made of a copper nickel alloy; upper-face electrode layers which make surface contact with the upper faces of both the end portions of the resistance layer; and end-face electrodes which are formed so as to cover the upper-face electrode layers. Since the bonding between the resistance layer and the upper-face electrode layers is conducted by metal-to-metal bonding, particularly, impurities which may affect the properties do not exist in the interface. As a result, it is possible to realize a chip resistor which is excellent in heat resistance, and which has a low resistance and a low TCR.

14 Claims, 6 Drawing Sheets

CHIP RESISTOR

BACKGROUND OF THE INVENTION 1. (Technical Field)

The invention relates to a chip resistor which is widely used in an electronic circuit, particularly to a chip resistor which has a low resistance and a low TCR, and also to a method of producing the resistor.

2. (Background Art)

Recently, as typically exemplified by a portable telephone, a movie camera, and a notebook-type personal computer, demands for small electronic apparatuses are growing. It is no exaggeration that miniaturization and improvement of the performance of such electronic apparatuses will depend on those of chip-type electronic parts to be used in the apparatuses. As a thin film resistor body, known are ruthenium oxide and a composition which contains bismuth ruthenate and lead ruthenate that are complex oxides of ruthenium oxide, as main components (for example, see the Unexamined Japanese Patent Application Publication No. Sho 58-37963). Such a resistor body is used in various fields.

An example of a method of producing a conventional chip resistor will be described with reference to the accompanying drawings. FIG. 12 is a perspective view showing an example of the structure of a conventional chip resistor, and FIG. 13 is a section view taken along the line A—A' of FIG. 12. Usually, a chip resistor of this kind is produced in the following manner. First, upper electrodes 11 are formed on the upper face of a chip-like alumina substrate 10 which is made of alumina of 96% purity. A resistor body 12 is formed on a part of the upper face of the alumina substrate 10 so as to be connected with the upper electrodes. A protective film 14 which is made of lead borosilicate glass is formed so as to cover the whole of the resistor body 12. Usually, the protective film 14 is formed by forming a pattern by means of screen printing and then firing the film at a temperature as high as 500 to 800° C.

Next, end-face electrodes 13 each consisting of an Ag thick film are formed on the end faces of the alumina substrate 10 so as to be connected with the upper electrodes 11, respectively. Usually, the end-face electrodes 13 are formed by conducting a firing process at a high temperature of about 600° C. In order to ensure the reliability in a soldering process, finally, Ni plated films 15 are formed by electroplating so as to cover the end-face electrodes 13, and solder plated films 16 are formed so as to cover the Ni plated films 15, thereby completing a chip resistor.

In a chip resistor produced by such a production method, generally, a thick film glaze resistor body material which contains ruthenium oxide as a main component is used as conductive particles constituting the resistor body. However, a resistor body material which contains only ruthenium oxide has a large temperature coefficient of resistance (hereinafter, often abbreviated as "TCR") which indicates a change of the resistance with temperature. Therefore, the material must be used after the TCR is reduced to a small value of about ±50 ppm/°C. or less by adding a TCR adjustment material such as a metal oxide.

When such a resistor body material is used, however, it is difficult to produce a chip resistor having a low resistance of 1 Ω or less because ruthenium oxide has high resistivity. To comply with this, a chip resistor has been proposed in which a copper nickel alloy having a low temperature coefficient of resistance, such as that described in JIS C2521 and JIS C2532 is used as a resistor body material of a low resistance of 1 Ω or lower.

Specifically, a structure is proposed in which such an alloy material is formed into a foil-like or plate-like shape and then applied to an alumina substrate, and that in which resistor body paste obtained by kneading copper powder, nickel powder, and a glass frit in an organic vehicle is printed on an alumina substrate and then fired in an inert atmosphere, thereby forming an alloy film (see the Unexamined Japanese Patent Application Publication Nos. Hei 2-308501 and Hei 3-270104).

In the former structure, however, the mass productivity is not highly excellent because of the following reason. Under the situation where miniaturization of a chip part is growing, a method of working alloy foil or an alloy plate has a limit, a trimming process cannot use a laser, and other processes such as grinding have a limit. Furthermore, also from the view point of cost, the method is more disadvantageous than the printing method.

In the latter structure, the bonding between the resistor body film and the substrate, and the adjustment of the resistance layer are realized by using glass, and hence components other than copper-nickel are contained at high ratios. Consequently, the temperature coefficient is different from that of a copper nickel alloy. Depending on the firing conditions, furthermore, the glass component exhibits diffusion behavior in the metal components and at the interface between sintered particles in different manners. Therefore, the latter structure has a problem in that a stable resistance property is hardly obtained.

In the paste method using copper powder and nickel powder, the properties of a resistor are largely affected by the properties of terminal electrodes of a power supply portion, and the structure of the interface between the resistor body and an electrode. The minimum resistance which can be produced by the method is limited to 100 mΩ. It is difficult to realize a lower resistance.

As described above, the recent tendency to miniaturization of a chip resistor is growing. On the other hand, the needs for a chip resistor which may be used in current detection in an electronic circuit, and the like and which has a low resistance and a low TCR is increasing. From the view point of the performance required in a use, moreover, a chip resistor which can ensure high accuracy and high reliability in addition to a low resistivity and a low TCR is eagerly requested.

SUMMARY OF THE INVENTION

The invention has been conducted in order to solve the above-discussed problems and satisfy the requirements. It is an object of the invention to provide a chip resistor which has a low resistance of 1 Ω or less, particularly 100 mΩ or less and a low TCR, and which is highly reliable.

(Disclosure of Invention)

The chip resistor of the invention comprises: an insulating substrate; a resistance layer which is formed on at least one face of the insulating substrate and which is made of a copper nickel alloy; a pair of upper-face electrode layers which respectively make surface contact with upper faces of both end portions of the resistance layer; and a pair of end-face electrodes which are formed on both end portions of the insulating substrate so as to cover at least parts of the upper-face electrode layers, respectively. Particularly, the bonding between the resistance layer and the upper-face electrode layers is realized by metal-to-metal bonding, and hence impurities which may affect the properties do not exist in the interface. As a result, a chip resistor which has a low resistance and a low TCR and which is excellent in heat resistance can be obtained.

DETAILED DESCRIPTION OF THE PREFERRED EMBODIMENTS (Embodiment 1)

Figure 1:
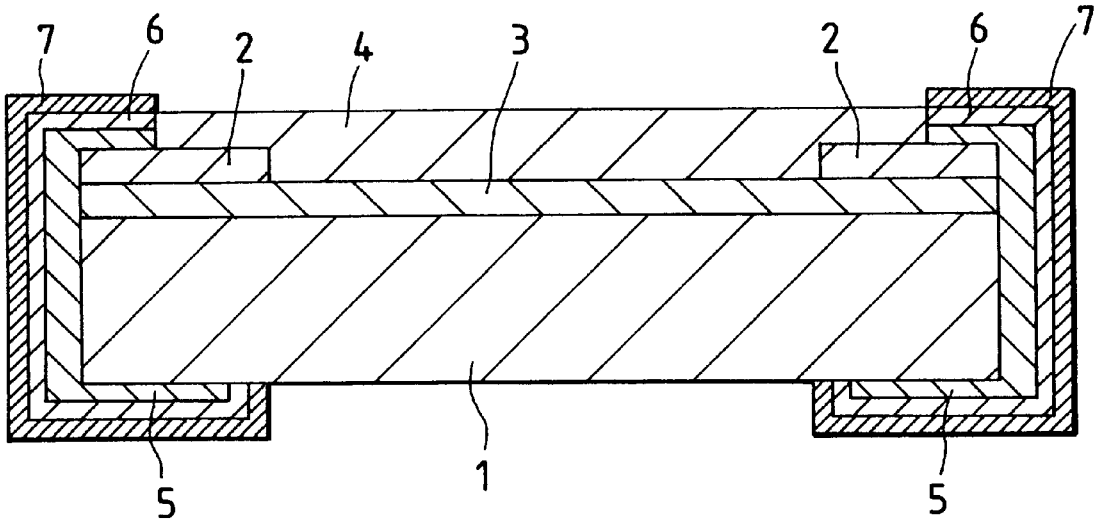
FIG. 1 is a schematic section view of a chip resistor which is a first embodiment of the invention.

FIG. 1 is a schematic section view of a chip resistor which is a first embodiment of the invention. In the figure, 3 designates a resistance layer. The resistance layer is printed on one face of a square insulating substrate (hereinafter, referred to as merely "substrate") 1 by the thick film technique such as screen printing with using resistor body paste of an alloy composition which is shown in Table 1 below. Next, upper-face electrode layers 2 are respectively printed in the same manner as the resistance layer 3 on a pair of end portions of the resistance layer 3 opposing the substrate 1, so as to make surface contact with the resistance layer 3. The resistance layer 3 and the upper-face electrode layers 2 are simultaneously fired in a neutral or reducing atmosphere. Thereafter, a protective film layer 4 is formed so as to cover a part of the resistance layer 3. End-face electrode layers 5 are formed into a U-like shape in the pair of opposing end portions of the substrate 1 and on portions of the resistance layer 3 which are not covered by the protective film layer 4. Furthermore, Ni plated films 6 covering the end-face electrode layers 5 are formed, and solder plated films 7 are formed on the Ni plated films 6.

Hereinafter, a method of producing the chip resistor will be described in detail. In the resistor body paste, copper nickel alloy powder (atomized powder of the mean particle diameter of 5 μm) was used. A glass frit was added to the powder so as to configure the resulting mixed powder as an inorganic composition. As the glass frit, lead borosilicate glass was added in a proportion of 5 wt. % with respect to the metal powder, and, as a vehicle component, a solution in which ethyl cellulose functioning as an organic binder was dissolved in terpineol was used so as to serve as an organic vehicle composition. The inorganic composition and the organic vehicle composition were kneaded by a three-roll mill to be formed into the resistor body paste.

In the paste for the upper-face electrodes, copper powder (mean particle diameter: 2 μm) or silver powder (mean particle diameter: 5 μm) was used, and, as a vehicle component, a solution in which ethyl cellulose functioning as an organic binder was dissolved in terpineol was used so as to serve as an organic vehicle composition. The inorganic composition and the organic vehicle composition were kneaded by a three-roll mill to be formed into the upper-face electrode paste.

A resistor body pattern was printed on the substrate 1 (96% alumina substrate) by using the thus prepared resistor body paste and a screen plate. The resistor body pattern was dried at 100° C. for 10 minutes. The upper-face electrode paste was then printed on the upper face of the resistor body pattern by using a screen plate, into a predetermined pattern shown in FIG. 1. The pattern was dried at 100° C. for 10 minutes. The substrate 1 was subjected to simultaneous firing for the resistor body and the electrodes in a profile which enables firing in a nitrogen atmosphere, thereby simultaneously forming the resistance layer 3 and the upper-face electrode layers 2. The substrate 1 was split into a separate piece, and copper electrodes were disposed as the end-face electrodes 5. Thereafter, the protective film layer 4 was formed by an epoxy resin by means of screen printing as a protective film for the resistance layer 3, and the resin was cured under the conditions of 160° C. and 30 minutes. The resulting resistance element was evaluated with respect to the resistance, the temperature coefficient of resistance (TCR), and the reliability (a high-temperature shelf test and a thermal shock test).

Figure 13:
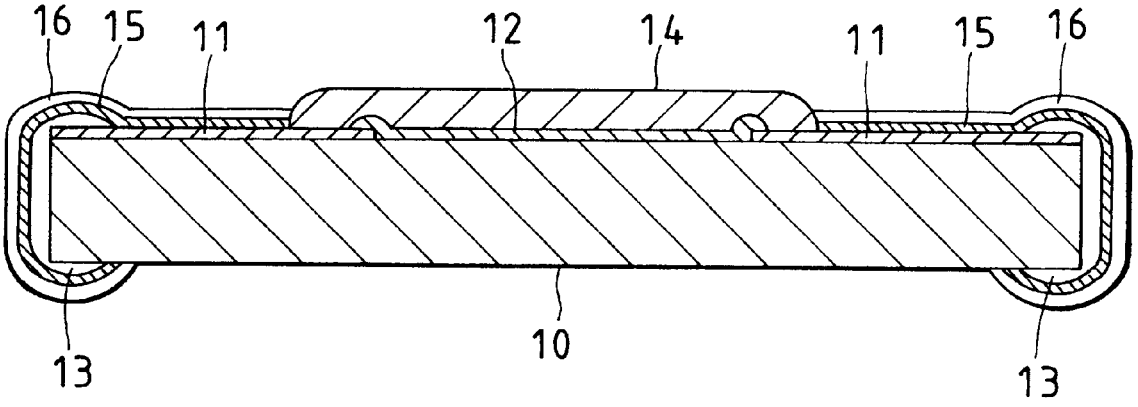
FIG. 13 PRIOR ART
FIG. 13 is a section view taken along the line A—A' of FIG. 12.

Comparison examples having a structure shown in FIG. 13 were produced in the following manner. Copper or silver electrodes containing a glass frit were formed as upper electrodes 11. Then, paste in which alloy powder, glass, and an organic vehicle were mixed in a similar manner as described above was printed on an alumina substrate 10 (96% alumina substrate). The paste was dried at 100° C. for 10 minutes and then heated in an $N_2$ atmosphere under firing conditions shown in Table 1, thereby firing a resistor body.

The method of evaluating the fired resistor will be described. The resistance was measured by the four-terminal method after a sample was allowed to stand for 30 minutes or longer in an atmosphere of a temperature of 25±2° C. and a relative humidity of 65±10%. The TCR was measured in the following manner. A sample was placed in a thermostatic chamber and allowed to stand for 30 minutes or longer in a certain temperature atmosphere. Thereafter, the resistance was measured at 25° C. and 125° C., and the rate of change of the resistance was obtained.

The thermal shock test which is an evaluation item of the reliability was conducted in the following manner. Two test chambers (−45° C. and +150° C.) which are preset to respective predetermined temperatures were used. A test in which, immediately after a sample was held in one of the test chambers for 30 minutes, the sample was exposed in the other test chamber for 30 minutes was repeated 500 cycles. Thereafter, the rate of change of the resistance was evaluated. In the high-temperature shelf test, the rate of change of the resistance was evaluated after a sample was allowed to stand for 1,000 hours in a test chamber held to 150° C.

The crystal structure of a section of the alloy layer of a produced resistor was obtained by using an X-ray diffractometer.

TABLE 1

| Alloy Ratio of Cu/Ni (wt %) | Comparative Example 70/30 + Glass Frit 5 wt % | | 70/30 + Glass Frit 5 wt % | | | | | |
|---|---|---|---|---|---|---|---|---|
| Upper Electrode | Copper Powder + Glass Frit 5 wt % | Silver Powder + Glass Frit 5 wt % | | | | | | |
| Upper Face Electrode | | | Copper Electrodes | | | Silver Electrodes | | |
| Firing Temp. (° C.) | 900 | 850 | 600 | 900 | 1000 | 600 | 800 | 850 |
| Firing Time (hours) | 10 | 10 | 30 | 10 | 10 | 10 | 10 | 10 |
| Resistance (mΩ) | 60 | 80 | 70 | 40 | 10 | 90 | 70 | 60 |
| TCR (ppm/° C.) | 15 | 40 | −10 | 10 | 20 | −20 | 10 | 40 |
| Thermal Shock Test (−40° C. to +85° C., 500 cyc.) | ±4% | ±5% | ±0.4% | ±0.2% | ±0.1% | ±0.5% | ±0.3% | ±0.2% |
| High Temp. Shelf Test (150° C., 1000 hrs) | ±5% | ±6% | ±0.7% | ±0.4% | ±0.2% | ±0.9% | ±0.5% | ±0.3% |

From the results listed in Table 1, it will be seen that, in the comparison examples which were produced so as to have the structure of the prior art, the connection between the resistor body film and the upper electrode is insufficient from the view point of the quality of a resistor body which is requested to have high accuracy and high reliability. When the film quality was checked by means of the section observation, it was observed that the glass frit exists in the interface between the resistor body 12 and the upper electrodes 11 and many voids are formed in the interface. As a result, it was seen that densification due to sintering is not sufficiently attained.

By contrast, it was seen that no glass frit exists in the interface between the resistance layer 3 and the upper-face electrode layers 2 which were produced by the method of the invention and hence no impurity is in the interface, and that a crystal structure in which a clear interface where the upper-face electrode layers 2 and the resistance layer 3 are combined with each other by metal diffusion is not formed was realized by the simultaneous sintering. This seems to mean that a structure in which simultaneous sintering causes copper or silver to diffuse in the copper nickel alloy layer serving as a resistance layer so as to form a diffusion layer not having a clear interface exhibits thermal stability having excellent reliability. The metal film after sintering was analyzed by an X-ray diffractometer, and then it was observed that a uniform copper nickel alloy layer is formed. When the film quality was observed by a scanning electron microscope, it was observed that a dense sintered film which is substantially free from voids is formed.

Figure 2:
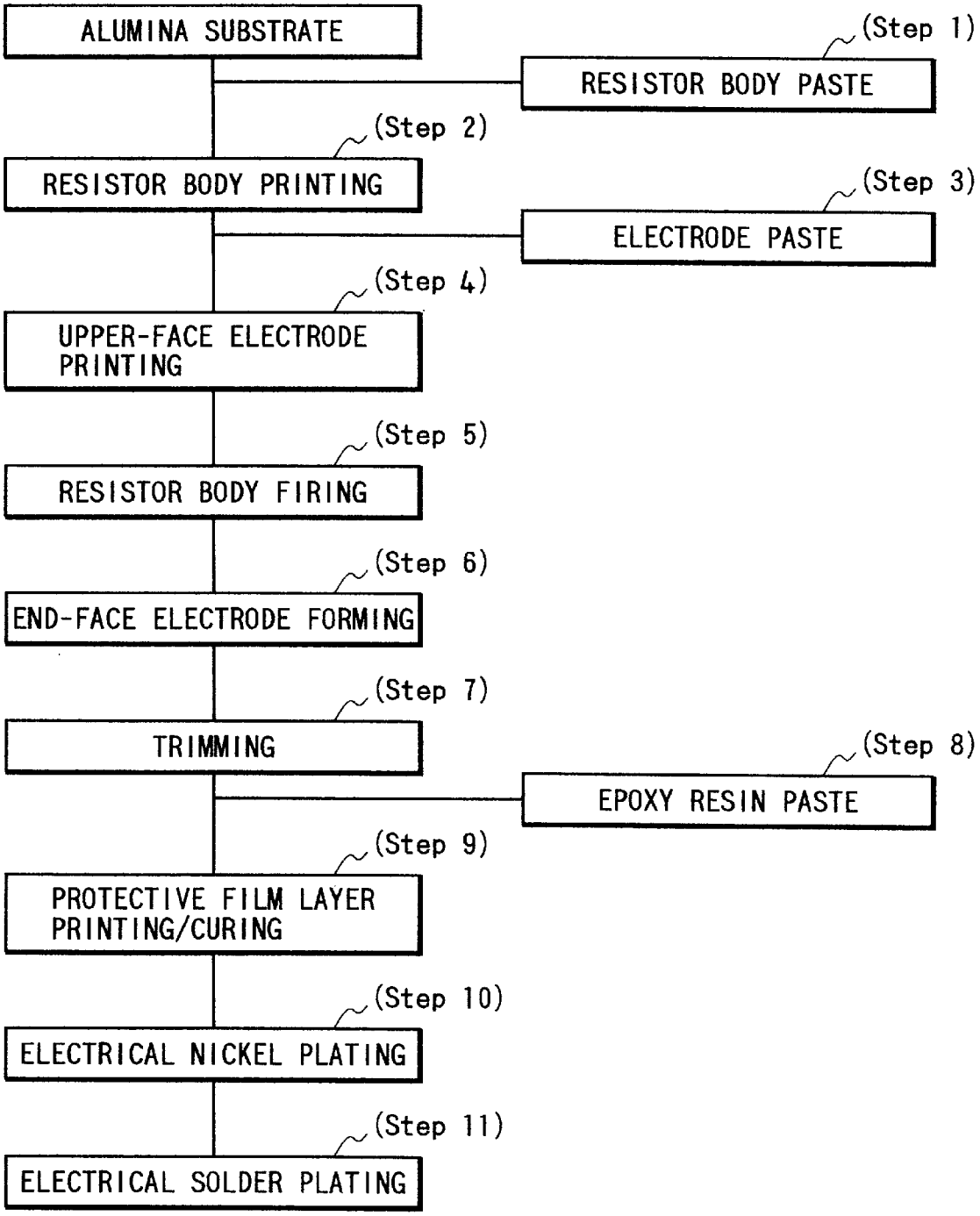
FIG. 2 is a production flow diagram of the embodiment.

Next, a specific method of producing the chip resistor will be described with reference to the production flow diagram of FIG. 2.

Resistor body compositions of different ratios of copper nickel alloy powder to a glass frit were mixed with each other by a three-roll mill to prepare resistor body paste of a viscosity of 200,000 to 250,000 pascal-seconds (Step 1).

The paste was screen printed on an alumina substrate and then dried to form a resistor body (the size of the resistor body: 2 mm×2 mm, the dry film thickness: 40 μm) (Step 2). Copper powder (mean particle diameter: 2 μm) or silver powder (mean particle diameter: 5 μm) and an organic vehicle were kneaded by a three-roll mill to prepare electrode paste of a viscosity of 200,000 to 250,000 pascal-seconds (Step 3). The electrode paste was screen printed so as to form a structure in which the layers make surface contact with the upper face of the resistor body, and then dried (the dry film thickness: 30 μm) (Step 4). Thereafter, the substrate was held in a nitrogen atmosphere at 900° C. for 10 minutes to conduct firing, thereby producing the resistance layer 3 and the upper-face electrode layers 2 (Step 5).

Next, copper electrode paste which is commercially available was applied as the end-face electrodes to the end faces so as to have a film thickness of about 50 to 100 μm. The paste was fired in a nitrogen atmosphere at 800° C. for 10 minutes to form the end-face electrode layers 5 (Step 6). Thereafter, the resistance layer 3 were cut and trimmed by a YAG laser (Step 7), and then epoxy resin paste (Step 8) was printed as a protective film on the resistance layer and then cured (the cured film thickness: 40 μm, held at 150° C. for 30 minutes for curing), thereby producing the protective film layer 4 (Step 9).

In order to attain a chip part, Ni plating 6 and solder plating 7 were then conducted on the end faces (Steps 10 and 11), whereby a design for enhancing the solder wettability during a mounting process was executed.

As apparent from Table 1, it will be seen that the resistor produced by the method described above has sufficiently high reliability with respect to the heat resistance property such as a high-temperature shelf test and a thermal shock test. The resistance is stable at a high temperature because the interface between the metal layers is not clearly formed and the alloyed diffusion layer is formed. Furthermore, the upper-face electrode layers contain no glass frit functioning as impurities. Because of these reasons, a chip resistor which has a low resistance and a low TCR and which is excellent in heat resistance can be realized.

Usually, the temperature coefficient of resistance (TCR) can be adjusted in the range of 400 to −200 ppm/°C. by changing the copper/nickel alloy ratio. In the embodiment, the TCR can be suppressed in the range of 40 to −20 ppm/°C., in consideration of also the conditions of the firing temperature, and the resistance can cover a resistance range as low as 10 mΩ. Moreover, the embodiment is excellent also in bonding strength which is required in a resistor body. Regarding also other evaluation items, the embodiment has durability which is practically sufficiently high as a resistor body.

In the embodiment, resin paste was used as the protective film. It is a matter of course that, even when glass paste which is more popular is used in place of resin paste, similar effects can be attained.

(Embodiment 2)

Hereinafter, a chip resistor obtained by printing and firing resistor body paste which was prepared by using alloy powder of the mixture ratio composition shown in Table 2 and in a similar manner as Embodiment 1 will be described.

The thus produced chip resistor was evaluated with respect to the resistance, the temperature coefficient of resistance (TCR), and the reliability (a high-temperature shelf test and a thermal shock test).

Comparison examples were produced in the following manner. Paste in which alloy powder, a glass frit, and an organic vehicle were mixed in a similar manner as Embodiment 1 was printed by using a screen plate on an alumina substrate 10 on which upper electrodes 11 such as shown in FIG. 13 were formed. The paste was dried at 100° C. for 10 minutes and then heated to 1,000° C. in an $N_2$ atmosphere, thereby firing a resistor body. Thereafter, the end-face electrodes and the protective film were formed in a similar manner as Embodiment 1, thereby completing a chip resistor.

The resistors after firing were evaluated in a similar manner as Embodiment 1. The evaluation results are shown in Table 2.

As apparent from Table 2, a crystal structure in which no impurity exists in the interface between the resistance layer 3 and the upper-face electrode layers 2 which are produced by the method of the embodiment and a clear interface where the upper-face electrode layers 2 and the resistance layer 3 are combined with each other by metal diffusion is not formed was realized by the simultaneous sintering. This shows that a structure in which simultaneous sintering forms diffusion layers not having a clear interface exhibits thermal stability having excellent reliability. From these, it will be seen that a chip resistor which has a low resistance and a low TCR and which is excellent in heat resistance can be obtained.

In the case where copper electrodes are used as the upper-face electrode layers, the resistance and the temperature coefficient of resistance are excellent in reproducibility as far as the firing temperature is within the range of 600 to 1,000° C. In the case where silver electrodes are used, the resistance and the temperature coefficient of resistance are excellent in reproducibility as far as the firing temperature is within the range of 600 to 850° C. In the case where silver electrodes are used, however, the temperature cannot be set to be a higher level because alloying of silver and copper of the resistance layers occurs at a low temperature. When firing is conducted in a reducing atmosphere in place of a nitrogen atmosphere, it is possible to realize a lower resistance.

(Embodiment 3)

Figure 3:
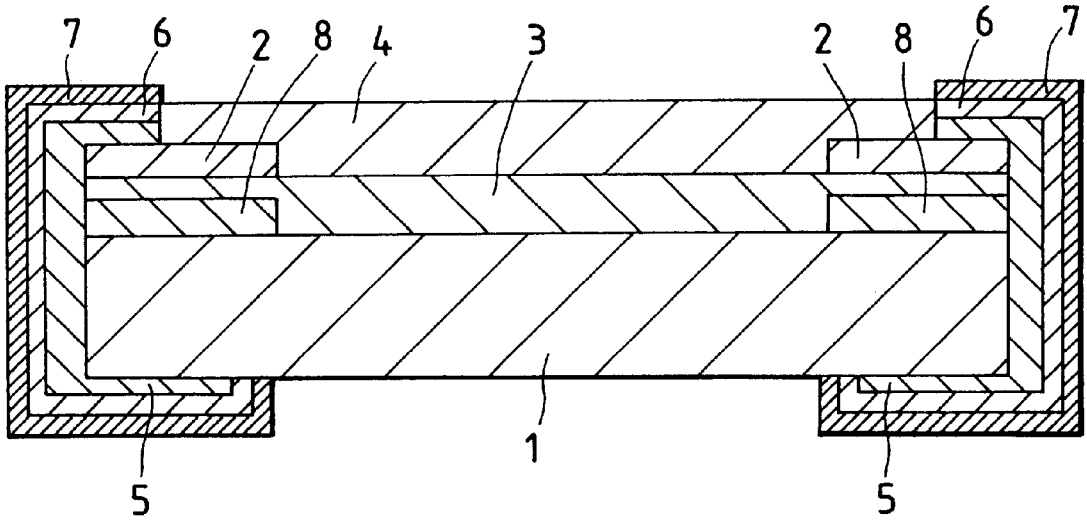
FIGS. 3 to 9 are schematic section views of chip resistors which are third to ninth embodiments of the invention, respectively.

FIG. 3 is a schematic section view of a chip resistor which is a third embodiment of the invention. In the chip resistor, lower-face electrode layers 8 are respectively printed and fired by the thick film technique such as screen printing on a pair of opposing end portions of one face of a square substrate 1. In the lower-face electrode layers 8, copper or silver powder was used as metal powder, and electrode paste in which lead borosilicate glass was added as a glass frit in a proportion of 3 wt. % with respect to the metal powder was

TABLE 2

| Alloy Ratio of Cu/Ni (wt %) | Comparative Example 40/60 + Glass Frit 3 wt % | | 40/60 + Glass Frit 3 wt % | | | | | |
|---|---|---|---|---|---|---|---|---|
| Upper Electrode | Copper Powder + Glass Frit 5 wt % | Silver Powder + Glass Frit 5 wt % | | | | | | |
| Upper Face | | | Copper Electrodes | | | Silver Electrodes | | |
| Firing Atmosphere | $H_2$ 1%-nitrogen Atmosphere (Reducing Atmosphere) | | | | | | | |
| Firing Temp. (° C.) | 900 | 850 | 600 | 900 | 1000 | 600 | 800 | 850 |
| Firing Time (hours) | 10 | 10 | 30 | 10 | 10 | 10 | 10 | 10 |
| Resistance (mΩ) | 50 | 70 | 60 | 30 | 10 | 80 | 60 | 50 |
| TCR (ppm/° C.) | 35 | 50 | −30 | 20 | 15 | −15 | 10 | 30 |
| Thermal Shock Test (−40° C. to +85° C., 500 cyc.) | ±5% | ±6% | ±0.7% | ±0.3% | ±0.2% | ±0.6% | ±0.5% | ±0.3% |
| High Temp. Shelf Test (150° C., 1000 hrs) | ±6% | ±7% | ±0.5% | ±0.3% | ±0.2% | ±0.8% | ±0.4% | ±0.3% |

used. Next, as shown in FIG. 3, a resistance layer 3 is printed on the lower-face electrode layers 8 by the thick film technique such as screen printing with using resistor body paste of an alloy composition which is shown in Table 3 below. Next, upper-face electrode layers 2 are respectively printed in the same manner as the resistance layer 3 on a pair of end portions of the resistance layer 3 opposing the substrate 1, so as to make surface contact with the resistance layer 3. The resistance layer 3 and the upper-face electrode layers 2 are simultaneously fired in a neutral or reducing atmosphere. Thereafter, a protective film and end-face electrodes are formed in a similar manner as Embodiment 1.

The resulting chip resistors were evaluated with respect to the resistance, the temperature coefficient of resistance (TCR), and the reliability (a high-temperature shelf test and a thermal shock test) in a similar manner as Embodiment 1.

In Embodiments 1 to 3, preferably, the thick film resistor body composition is fired at a high temperature (600 to 1,000° C.) in order to lower the resistance, and the glass frit is a high-melting glass frit having a glass transition point of 450 to 800° C., and particularly is one or more kinds of lead borosilicate glass and zinc borosilicate glass. Generally, a resistor preferably has a temperature coefficient of resistance which is in the vicinity of zero. From the view points of performance and cost, therefore, the value of the coefficient is selected to be ±400 ppm/°C. According to the embodiments, a cost performance ratio which is improved by about ten times is obtained.

As a material of the substrate, any material may be used as far as it can withstand a firing temperature of 600 to 1,000° C. For example, a wide variety of substrates of alumina, forsterite, mullite, aluminum nitride, and glass ceramics can be used.

TABLE 3

| Alloy Ratio of Cu/Ni (wt %) | Comparative Example 70/30 + Glass Frit 5 wt % | | 70/30 + Glass Frit 5 wt % | | | | | |
|---|---|---|---|---|---|---|---|---|
| Upper Electrode | Copper Powder + Glass Frit 5 wt % | Silver Powder + Glass Frit 5 wt % | | | | | | |
| Upper Face Electrode | Copper Electrodes | | | | | | | |
| Lower Face Electrode | Copper Powder + Glass Frit 4 wt % | | | | | | | |
| Firing Temp. (° C.) | 900 | 850 | 600 | 900 | 1000 | 600 | 900 | 1000 |
| Firing Time (hours) | 10 | 10 | 30 | 10 | 10 | 10 | 10 | 10 |
| Firing Atmosphere | Nitrogen Atmosphere | | Nitrogen Atmosphere | | | $H_2$ 3%-nitrogen Atmosphere | | |
| Resistance (mΩ) | 60 | 80 | 70 | 30 | 10 | 60 | 20 | 10 |
| TCR (ppm/° C.) | 15 | 40 | −20 | 30 | 40 | −30 | 20 | 50 |
| Thermal Shock Test (−40° C. to +85° C., 500 cyc.) | ±4% | ±5% | ±0.4% | ±0.2% | ±0.1% | ±0.4% | ±0.2% | ±0.1% |
| High Temp. Shelf Test (150° C., 1000 hrs) | ±5% | ±6% | ±0.7% | ±0.3% | ±0.2% | ±0.6% | ±0.3% | ±0.2% |

As apparent from Table 3, according to the third embodiment, it is possible to obtain a resistor body which has a very low resistance and which shows very excellent properties in a long-term reliability test for thermal shock and heat resistance properties. Also the reliability of various electric properties is excellent.

Resistor bodies which were produced as comparison examples by a prior art method showed performance which is insufficient from the view point of long-term reliability for heat resistance.

As described above, according to Embodiments 1 to 3, the upper-face electrode layers and the resistance layer have the alloyed interface, and hence an electrode structure which is stable in heat resistance property can be obtained, a highly accurate chip resistor which has a low resistance and a low TCR and in which the change of the resistance is very small in degree in the long-term reliability for heat resistance can be realized, and an advantageous effect that a resistor can be economically produced is attained.

(Embodiment 4)

Figure 4:
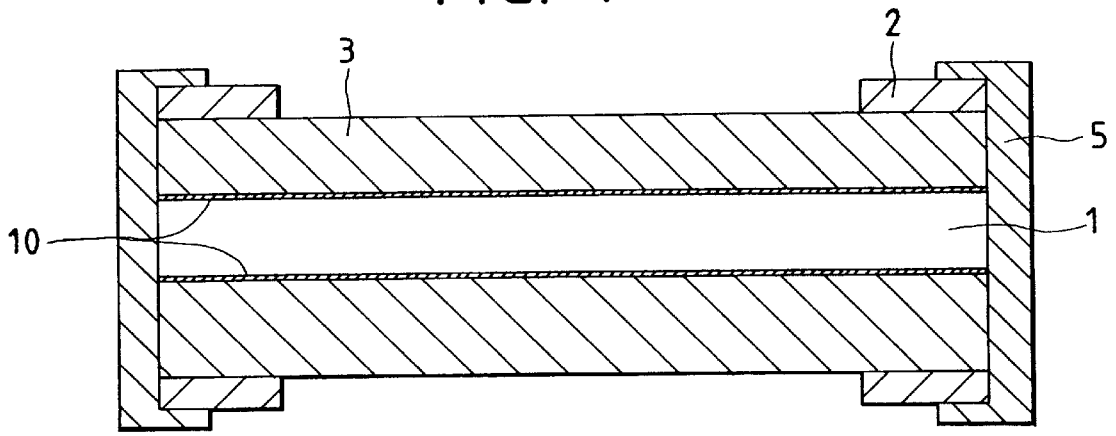

FIG. 4 is a schematic section view of a chip resistor which is a fourth embodiment of the invention. In the figure, 3 designates a resistance layer. The resistance layer is printed on both the faces of a square ceramic substrate (hereinafter, referred to as merely "substrate") 1 by the thick film technique such as screen printing with using resistor body paste of an alloy composition which is shown in Table 4 below. Next, upper-face electrode layers 2 are respectively printed in the same manner as the resistance layer 3 on both the end portions of the resistance layer 3, so as to make surface contact with the resistance layer 3. A pair of U-shaped end-face electrode layers 5 are formed on both the side faces of the substrate 1 so as to cover at least parts of the upper-face electrode layers 2, respectively. These layers are simultaneously fired in a neutral or reducing atmosphere.

Hereinafter, a method of producing the resistor body paste will be described. Atomized powder of the mean particle diameter of 2 μm was used as copper nickel alloy powder. Glass was added to the powder so as to configure the resulting mixed powder as an inorganic composition. As a vehicle, a solution in which ethyl cellulose functioning as an organic binder was dissolved in terpineol was used so as to serve as an organic composition. The inorganic composition and the organic composition were kneaded by a three-roll mill to be formed into the resistor body paste for forming the resistance layer 3.

Next, a method of producing electrode paste for forming the upper-face electrode layers 2 will be described. Copper powder of the mean particle diameter of 2 μm was used so as to serve as an inorganic composition. As a vehicle, a solution in which ethyl cellulose functioning as an organic binder was dissolved in terpineol was used so as to serve as an organic composition. The inorganic composition and the organic composition were kneaded by a three-roll mill to be formed into electrode paste for the upper-face electrode layers 2.

Hereinafter, a method of producing the chip resistor will be described. First, the resistor body paste for the resistance layer 3 was printed on both the faces of the substrate 1 (96% alumina substrate, 6.4 mm×3.2 mm), and then dried at 100° C. for 10 minutes. Next, the electrode paste for the upper-face electrode layers 2 was screen printed so as to form a structure in which the layers make surface contact with the upper face of the resistance layer 3, and then dried. As the end-face electrode layers 5, thereafter, copper electrode paste which is commercially available was applied to the end faces so as to have a film thickness of about 50 to 100 μm. Then, these layers were fired in a nitrogen atmosphere at 900° C. for 10 minutes, thereby producing the chip resistor shown in FIG. 4.

Figure 10:
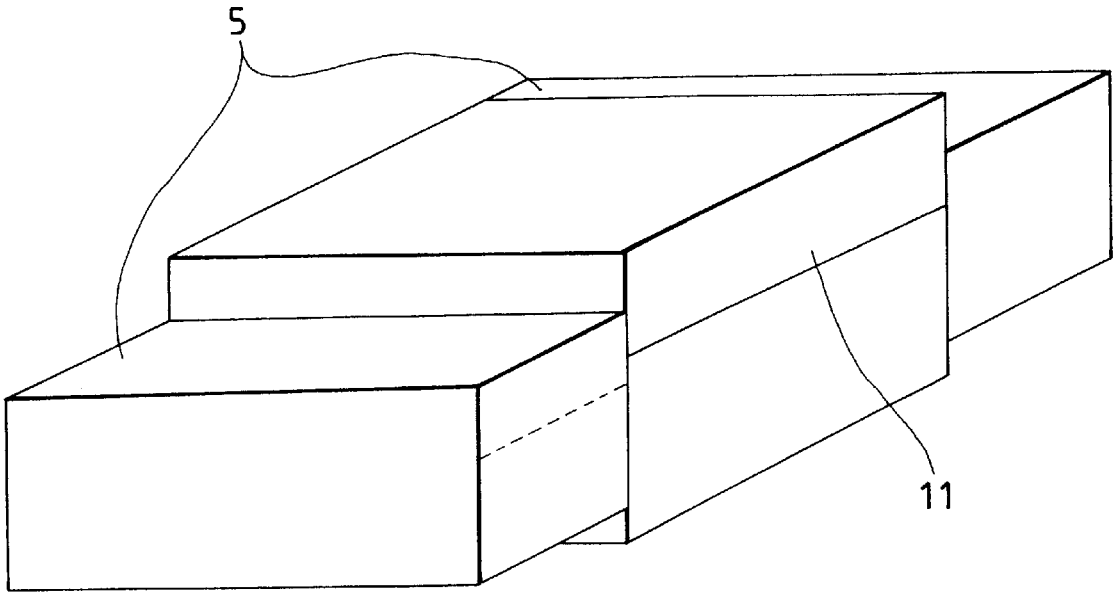
FIG. 10 is a perspective view showing a manner of applying a resin coating as a protective layer in the chip resistor of the fourth embodiment of the invention.
Figure 11:
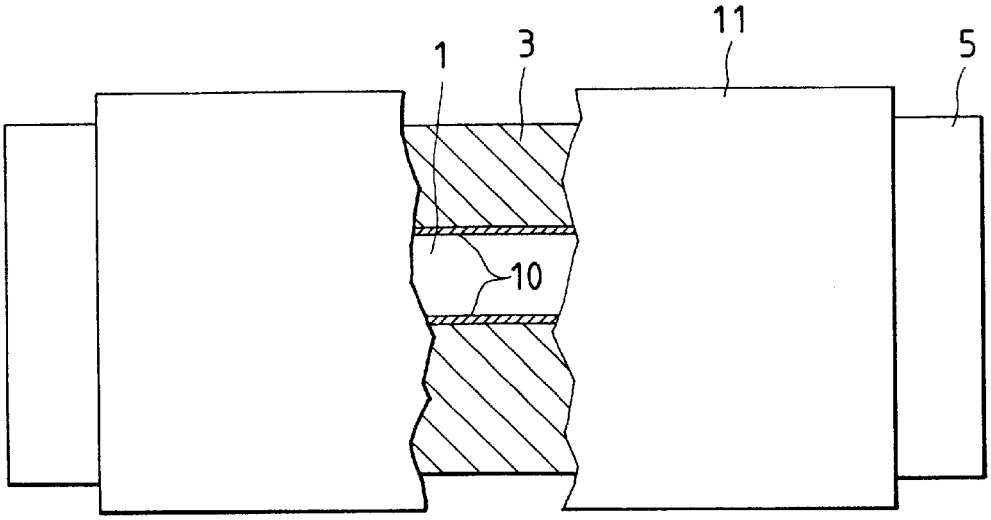
FIG. 11 is a partially cutaway side view of the chip resistor.
Figure 12:
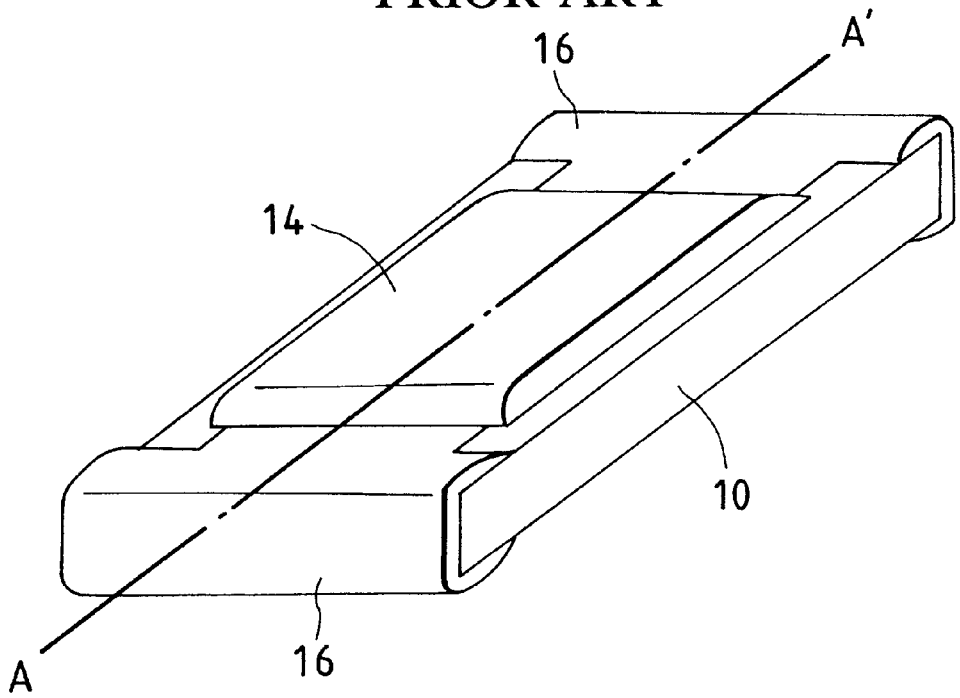
FIG. 12 PRIOR ART
FIG. 12 is a perspective view showing the structure of a conventional chip resistor.

Hereinafter, a method of evaluating the chip resistor will be described. The electrode distance between the upper-face electrode layers 2 of the chip resistor was set to be 4.0 mm, and the fired resistor body was formed so as to have a width of 2.5 mm. The resistance between terminals was obtained by the four-terminal method while probes were fixed to the upper-face electrode layers 2. The TCR was measured in the following manner. The chip resistor was placed in a thermostatic chamber, the resistance was measured at 25° C. and 125° C., and the rate of change of the resistance was obtained. With respect to the change of the resistance in the high-temperature shelf test, the fired resistor body film was coated with a resin serving as a protective resin layer 11 as shown in FIGS. 10 and 11, and the rate of change of the resistance was obtained after the chip resistor was allowed to stand at 160° C. for 1,000 hours.

The structure of a section of the produced chip resistor was investigated by using a scanning electron microscope, an electron-beam microanalyzer, or an X-ray microdiffractometer.

The results are shown in Table 4.

TABLE 4

900° C., 10 Minute Firing

| No. | Composite Ratio of Resistor Body (wt %) Cu:Ni:Mn:Cr:Fe | Film Thickness of Upper Resistor Body (μm) | Film Thickness of Back Face Resistor Body (μm) | Resistance Between Terminals (mΩ) | TCR (ppm/° C.) | Rate of Change of Resistance in High Temp. Shelf Test (%) |
|---|---|---|---|---|---|---|
| 1 | 70:30:0:0:0 | 30 | 100 | 5.0 | 80 | 2.0 |
| 2 | 70:29:1:0:0 | 30 | 100 | 5.2 | 65 | 2.0 |
| 3 | 70:29:0:1:0 | 30 | 100 | 5.1 | 70 | 2.5 |
| 4 | 70:29:0:0:1 | 30 | 100 | 5.5 | 60 | 3.0 |

As apparent from Table 4, according to the chip resistor of the embodiment, the formation of the resistance layer on both the faces enables a chip resistor of a low resistance, a low TCR, and high reliability to be obtained. Since fired particles of the resistor body layer have a diameter of 30 μm or less and the thickness of the layer is 40 μm or less, a trimming process using a YAG laser can be conducted. Generally, metal foil or a metal wire reflects the energy of a laser, and hence cannot be subjected to a laser trimming process. Other trimming processes such as sand blast cannot be conducted easily and highly accurately. Therefore, the chip resistor of the embodiment is very effective.

(Embodiment 5)

Figure 5:
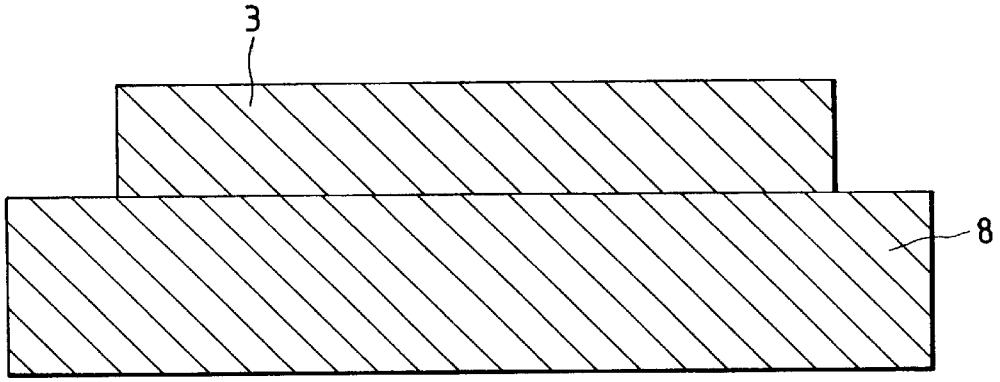

FIG. 5 is a schematic section view of a chip resistor which is a fifth embodiment of the invention. In the figure, 3 designates a resistance layer, and 8 designates metal foil (6.4 mm×3.2 mm, thickness=0.04 mm) of an alloy composition which is shown in Table 5 below. Resistor body paste for the resistance layer 3 was prepared in the same manner as Embodiment 4.

Hereinafter, a method of producing the chip resistor will be described. First, the resistor body paste for forming the resistance layer 3 was printed on the metal foil 8 and then dried at 100° C. for 10 minutes. Thereafter, the paste was fired in a nitrogen atmosphere at 900° C. for 10 minutes, thereby producing the chip resistor shown in FIG. 5.

The chip resistor was evaluated in a similar manner as Embodiment 4. The results are shown in the Table 5.

TABLE 5

900° C., 10 Minute Firing

| No. | Composite Ratio of Resistor Body (wt %) Cu:Ni:Mn:Cr:Fe | Composite Ratio of Metal Foil (wt %) Cu:Ni:Mn:Cr:Al | Film Thickness of Sintering Resistor Body (μm) | Resistance Between Terminals (mΩ) | TCR (ppm/° C.) | Rate of Change of Resistance in High Temp. Shelf Test (%) |
|---|---|---|---|---|---|---|
| 5 | 70:30:0:0:0 | 70:30:0:0:0 | 30 | 3.0 | 80 | 2.0 |
| 6 | 70:30:0:0:0 | 70:29:1:0:0 | 30 | 4.0 | 65 | 2.0 |
| 7 | 70:30:0:0:0 | 0:95:5:0:0 | 30 | 3.4 | 70 | 2.6 |
| 8 | 70:30:0:0:0 | 0:95:4:1:0 | 30 | 3.5 | 60 | 3.0 |

(Embodiment 6)

Figure 6:
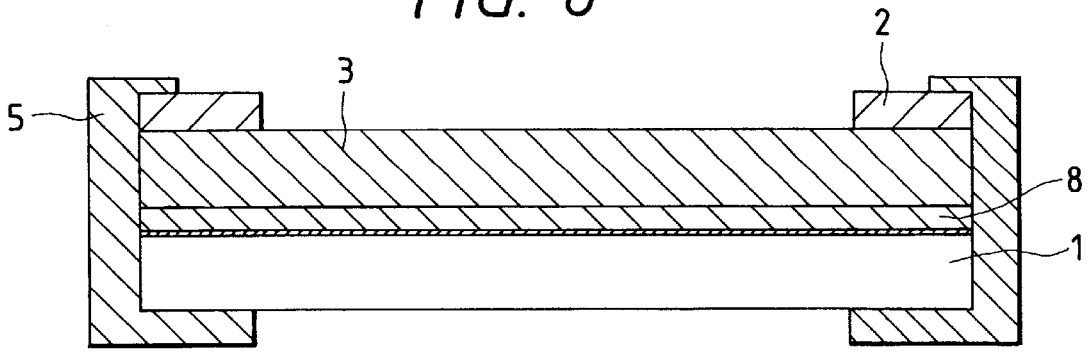

FIG. 6 is a schematic section view of a chip resistor which is a sixth embodiment of the invention. In the figure, 3 designates a resistance layer, and 8 designates metal foil such as shown in Table 6 below. The resistance layer is printed on both the faces of a square substrate 1 by the thick film technique such as screen printing with using resistor body paste of an alloy composition which is shown in Table 6 below. Next, upper-face electrode layers 2 are printed in both end portions of the resistance layers 3 in the same manner as the resistance layer 3 so as to make surface contact with the resistance layer 3. A pair of U-shaped end-face electrode layers 5 are formed on both the side faces of the substrate 1 so as to cover at least parts of the upper-face electrode layers 2, respectively. These layers are simultaneously fired in a neutral or reducing atmosphere.

The resistor body paste for the resistance layer 3, and the electrode paste for the upper-face electrode layers 2 were prepared in the same manner as Embodiment 4.

Hereinafter, a method of producing the chip resistor will be described. First, the metal foil 8 (3.8 mm×2.3 mm, thickness=0.02 mm) was fixed onto the substrate 1 (96% alumina substrate, 6.4 mm×3.2 mm) by bonding or the like. The resistor body paste for the resistance layer 3 was printed on the foil, and then dried at 100° C. for 10 minutes. Next, the electrode paste for forming the upper-face electrode layers 2 was screen printed so as to form a structure in which the layers make surface contact with the upper face of the resistance layer 3, and then dried. As the end-face electrode layers 5, thereafter, copper electrode paste which is commercially available was applied to the end faces so as to have a film thickness of about 50 to 100 μm. Then, these layers were fired in a nitrogen atmosphere at 900° C. for 10 minutes, thereby producing the chip resistor shown in FIG. 6.

The chip resistor was evaluated in a similar manner as Embodiment 4. The results are shown in the Table 6.

TABLE 6

900° C., 10 Minute Firing

| No. | Composite Ratio of Resistor Body (wt %) Cu:Ni:Mn:Cr:Fe | Composite Ratio of Metal Foil (wt %) Cu:Ni:Mn:Cr:Al | Film Thickness of Sintering Resistor Body (μm) | Resistance Between Terminals (mΩ) | TCR (ppm/° C.) | Rate of Change of Resistance in High Temp. Shelf Test (%) |
|---|---|---|---|---|---|---|
| 9 | 70:30:0:0:0 | 70:30:0:0:0 | 30 | 4.0 | 80 | 2.0 |
| 10 | 70:30:0:0:0 | 70:29:1:0:0 | 30 | 5.0 | 65 | 2.0 |
| 11 | 70:30:0:0:0 | 0:95:5:0:0 | 30 | 4.4 | 70 | 2.6 |
| 12 | 70:30:0:0:0 | 0:95:4:1:0 | 30 | 4.5 | 60 | 3.0 |

(Embodiment 7)

Figure 7:
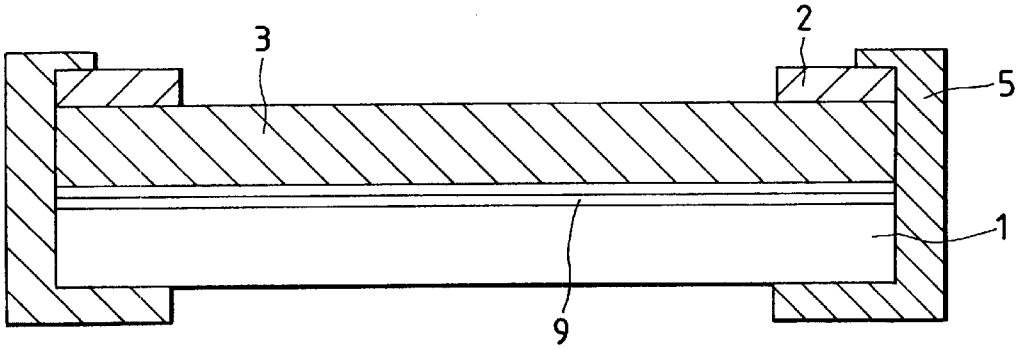

FIG. 7 is a schematic section view of a chip resistor which is a seventh embodiment of the invention.

In the embodiment, metal wires 9 such as shown in Table 7 were used in place of the metal foil 8 of the sixth embodiment. The metal wires 9 have a diameter of 0.6 mm and a length of 3.8 mm, and are fitted into slits (not shown) which are formed in the substrate 1.

The chip resistor was evaluated in the same manner as Embodiment 4. The results are shown in Table 7.

TABLE 7

900° C., 10 Minute Firing

| No. | Composite Ratio of Resistor Body (wt %) Cu:Ni:Mn:Cr:Fe | Composite Ratio of Metal Foil (wt %) Cu:Ni:Mn:Cr:Al | Film Thickness of Sintering Resistor Body (μm) | Resistance Between Terminals (mΩ) | TCR (ppm/° C.) | Rate of Change of Resistance in High Temp. Shelf Test (%) |
|---|---|---|---|---|---|---|
| 13 | 70:30:0:0:0 | 70:30:0:0:0 | 30 | 2.0 | 80 | 2.0 |
| 14 | 70:30:0:0:0 | 70:29:1:0:0 | 30 | 2.5 | 65 | 2.0 |
| 15 | 70:30:0:0:0 | 0:95:5:0:0 | 30 | 2.2 | 70 | 2.6 |
| 16 | 70:30:0:0:0 | 0:95:4:1:0 | 30 | 2.3 | 60 | 3.0 |

(Embodiment 8)

Figure 8:
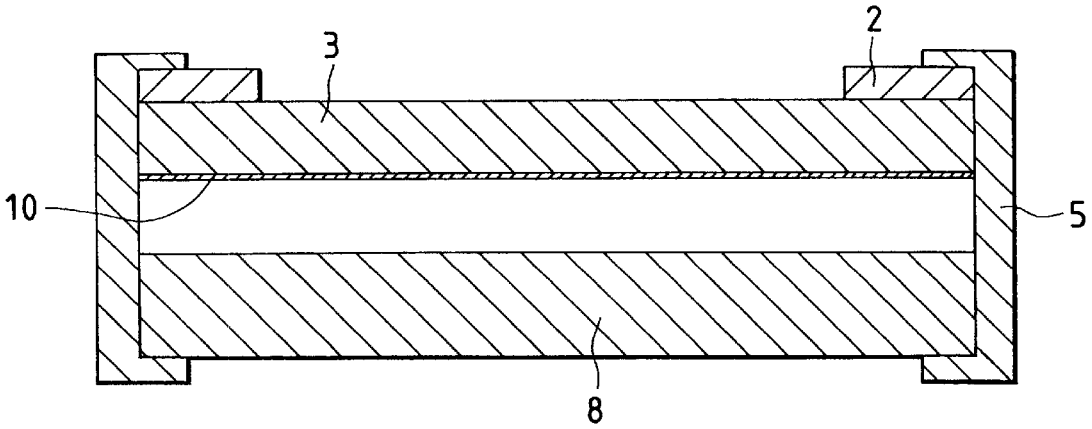

FIG. 8 is a schematic section view of a chip resistor which is an eighth embodiment of the invention. In the figure, 3 designates a resistance layer, and 8 designates metal foil such as shown in Table 8 below. The resistance layer is printed on the other face of a square substrate 1 by the thick film technique such as screen printing with using resistor body paste of an alloy composition which is shown in Table 8 below. Next, upper-face electrode layers 2 are printed at both the ends of the resistance layer 3 in the same manner as the resistance layer 3 so as to make surface contact with the resistance layer 3. A pair of U-shaped end-face electrode layers 5 are formed on both the side faces of the substrate 1 so as to cover at least parts of the upper-face electrode layers 2, respectively. These layers are simultaneously fired in a neutral or reducing atmosphere.

The resistor body paste for the resistance layer 3, and the electrode paste for the upper-face electrode layers 2 were prepared in a similar manner as Embodiment 4.

Hereinafter, a method of producing the chip resistor will be described. First, the metal foil 8 (6.4 mm×2.5 mm, thickness=0.1 mm) was fixed to one face of the substrate 1 (96% alumina substrate, 6.4 mm×3.2 mm) by bonding or the like, and the resistor body paste for forming the resistance layer 3 was printed on the face opposite to the metal foil 8. Then, a drying process was conducted at 100° C. for 10 minutes. Next, the electrode paste for forming the upper-face electrode layers 2 was screen printed so as to form a structure in which the layers make surface contact with the upper face of the resistance layer 3, and then dried. As the end-face electrode layers 5, thereafter, copper electrode paste which is commercially available was applied to the end faces so as to have a film thickness of about 50 to 100 μm. Then, these layers were fired in a nitrogen atmosphere at 900° C. for 10 minutes, thereby producing the chip resistor shown in FIG. 8.

The chip resistor was evaluated in a similar manner as Embodiment 4. The results are shown in Table 8.

TABLE 8

900° C., 10 Minute Firing

| No. | Composite Ratio of Resistor Body (wt %) Cu:Ni:Mn:Cr:Fe | Composite Ratio of Metal Foil (wt %) Cu:Ni:Mn:Cr:Al | Film Thickness of Sintering Resistor Body (μm) | Resistance Between Terminals (mΩ) | TCR (ppm/° C.) | Rate of Change of Resistance in High Temp. Shelf Test (%) |
|---|---|---|---|---|---|---|
| 17 | 70:30:0:0:0 | 70:30:0:0:0 | 30 | 1.0 | 100 | 2.0 |
| 18 | 70:30:0:0:0 | 70:29:1:0:0 | 30 | 1.2 | 85 | 2.0 |
| 19 | 70:30:0:0:0 | 0:95:5:0:0 | 30 | 1.1 | 90 | 2.6 |
| 20 | 70:30:0:0:0 | 0:95:4:1:0 | 30 | 1.0 | 80 | 3.0 |

(Embodiment 9)

Figure 9:
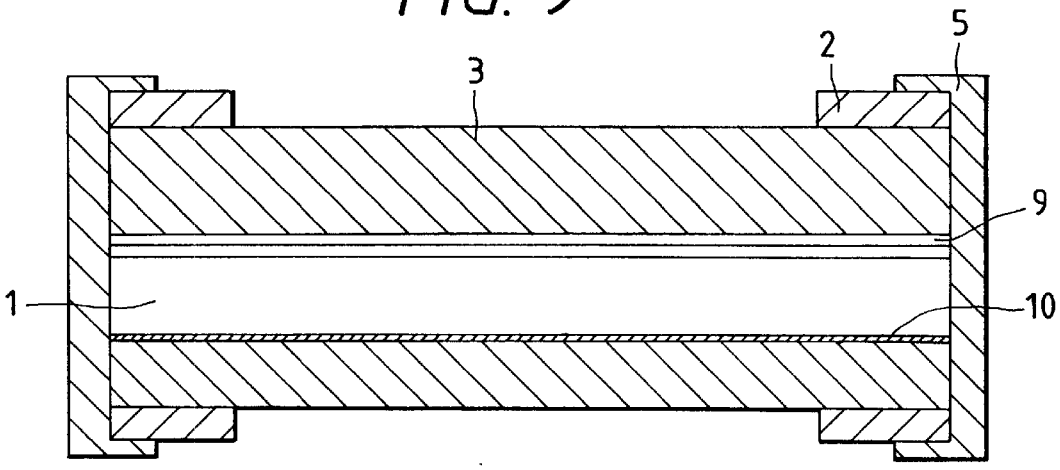

FIG. 9 is a schematic section view of a chip resistor which is a ninth embodiment of the invention. In the figure, 3 designates a resistance layer, and 9 designates metal wires such as shown in Table 9. The resistance layer is printed on both the faces of a square substrate 1 by the thick film technique such as screen printing with using resistor body paste of an alloy composition which is shown in Table 8. Next, upper-face electrode layers 2 are printed at both the ends of the resistance layer 3 in the same manner as the resistance layer 3 so as to make surface contact with the resistance layer 3. A pair of U-shaped end-face electrode layers 5 are formed on both the side faces of the substrate 1 so as to cover at least parts of the upper-face electrode layers 2 disposed on both the faces, respectively. These layers are simultaneously fired in a neutral or reducing atmosphere.

The resistor body paste for the resistance layer 3, and the electrode paste for the upper-face electrode layers 2 were prepared in a similar manner as Embodiment 4.

Hereinafter, a method of producing the chip resistor will be described. First, the metal wires 9 (the diameter=0.6 mm, the length=3.8 mm) are fittingly fixed into slits (not shown) which are formed in one face of the substrate 1 (96% alumina substrate, 6.4 mm×3.2 mm). Next, the resistor body paste for forming the resistance layer 3 was printed on both the both faces of the substrate and then dried at 100° C. for 10 minutes. Next, the electrode paste for forming the upper-face electrode layers 2 was screen printed so as to make surface contact with the upper faces of the resistance layers. As the end-face electrode layers 5, thereafter, copper electrode paste which is commercially available was applied to the end faces so as to have a film thickness of about 50 to 100 μm. Then, these layers were fired in a nitrogen atmosphere at 900° C. for 10 minutes, thereby producing the chip resistor shown in FIG. 9.

The chip resistor was evaluated in a similar manner as Embodiment 4. The results are shown in Table 9.

TABLE 9

900° C., 10 Minute Firing

| No. | Composite Ratio of Resistor Body (wt %) Cu:Ni:Mn:Cr:Fe | Composite Ratio of Metal Foil (wt %) Cu:Ni:Mn:Cr:Al | Film Thickness of Sintering Resistor Body (μm) | Resistance Between Terminals (mΩ) | TCR (ppm/° C.) | Rate of Change of Resistance in High Temp. Shelf Test (%) |
|---|---|---|---|---|---|---|
| 21 | 70:30:0:0:0 | 70:30:0:0:0 | 30 | 1.5 | 80 | 2.0 |
| 22 | 70:30:0:0:0 | 70:29:1:0:0 | 30 | 1.7 | 65 | 2.0 |
| 23 | 70:30:0:0:0 | 0:95:5:0:0 | 30 | 1.6 | 70 | 2.6 |
| 24 | 70:30:0:0:0 | 0:95:4:1:0 | 30 | 1.5 | 60 | 3.0 |

In Embodiments 4 to 9, the resistor bodies on the upper and back faces are electrically connected with each other by the end-face electrode layers 5. Alternatively, through holes or the like may be formed in the substrate 1 and the holes are buried by metal paste or a metal so as to electrically connect the resistor bodies with each other, thereby forming a low-resistance chip resistor. In the case where metal foil or metal wires are used, recesses and projections (slits) may be formed so that the metal foil or metal wires are fixed into the recesses. According to this configuration, a bonding process can be omitted, and the metal foil or metal wires can be surely fixed without using an adhesive containing a material which may affect the properties of the resistor. Therefore, this configuration is very effective.

In the above, the embodiments in which a trimming process using a YAG laser is conducted have been described. It is a matter of course that, even when the trimming process is conducted by using a laser of another kind, similar effects can be attained. The resistor body layer may be formed so as to have a thickness in the range where the trimming process by using the laser is enabled. Particularly, it has been experimentally found that it is preferable to set the diameter of fired particles to be 30 μm or less, and the thickness of the layer to be 40 μm or less.

(Industrial Applicability)

As described above, according to the invention, the bonding between the resistance layer and the upper-face electrode layers is conducted by metal-to-metal bonding, and hence impurities which may affect the properties do not exist in the interface. As a result, it is possible to realize a chip resistor which sufficiently utilizes the properties of a copper nickel alloy material so as to have a low resistance and a low TCR, which is excellent in heat resistance, and which has high reliability.

Furthermore, the resistor is configured so that the diameter of sintered particles of the fired resistor body layer is 30 μm or less and the film thickness of the layer is 40 μm or less. Consequently, a trimming process using a laser can be conducted. As compared with a grinding process using sand blast or the like, therefore, a trimming process can be conducted easily and highly accurately. As a result, it is possible to realize a chip resistor which is very economical and highly accurate.

What is claimed is:

1. A chip resistor comprising:

an insulating substrate;

a resistance layer which is formed on at least one face of said insulating substrate and which is made of copper-nickel alloy powder and a glass frit;

a pair of upper-face electrode layers which make surface contact with upper faces of end portions of said resistance layer; and a pair of end-face electrodes which are formed on both side faces of said insulating substrate so as to cover at least parts of said upper-face electrode layers;

wherein said resistance layer and said upper-face electrode layers are bonded together by metal-to-metal bonding.

2. The chip resistor of claim 1, wherein said upper-face electrode layers are lower in resistance than said resistance layer.

3. The chip resistor of claim 2, wherein said upper-face electrode layers are configured by electrodes selected from the group of copper electrodes and silver electrodes.

4. A chip resistor comprising:

an insulating substrate;

a pair of lower-face electrode layers which are formed in both end portions of at least one face of said insulating substrate;

a resistance layer which is formed so as to bridge said pair of lower-face electrode layers and which is made of copper nickel alloy powder and a glass frit;

a pair of upper-face electrode layers which make surface contact with upper faces of end portions of said resistance layer, said end portions respectively opposing said lower-face electrode layers; and a pair of end-face electrodes which are formed on both side faces of said insulating substrate so as to cover at least parts of said upper-face electrode layers;

wherein said resistance layer and said upper-face electrode layers are bonded together by metal-to-metal bonding.

5. The chip resistor of claim 4, wherein said upper-face electrode layers and said lower-face electrode layers are lower in resistance than said resistance layer.

6. The chip resistor of claim 4, wherein said upper-face electrode layers and said lower-face electrode layers are configured by electrodes selected from the group of copper electrodes and silver electrodes.

7. A chip resistor comprising:

fired resistance body layers which are formed on both faces of a ceramic substrate and which are made of at least copper nickel alloy powder;

terminal electrodes which are formed so as to cover at least parts of both end portions of said fired resistance body layers on both the faces; and end-face electrodes which are formed on side faces of said ceramic substrate so as to cover at least parts of both end portions of said terminal electrodes, wherein a diameter of sintered particles of said fired resistance body layer which is formed on at least one face of said ceramic substrate is 30 μm or less, a film thickness of said fired resistance body layer is 40 μm or less.

8. A chip resistor comprising:

metal foil made of material selected from the group of copper-nickel and nickel-chromium; and a fired resistance body layer which is formed on said metal foil and which is made of at least copper-nickel, wherein a diameter of sintered particles of said fired resistance body layer is 30 μm or less, a film thickness of said fired resistance body layer is 40 μm or less.

9. A chip resistor comprising:

metal foil formed on at least one face of a ceramic substrate and which is made of material selected from the group of copper-nickel and nickel-chromium;

a fired resistance body layer which is formed on said metal foil and which is made of at least copper-nickel;

a pair of terminal electrodes which are formed so as to cover at least parts of both end portions of said fired resistance body layer; and end-face electrodes which are formed on both side faces of said ceramic substrate so as to cover at least parts of both end portions of said terminal electrodes, wherein a diameter of sintered particles of said fired resistance body layer is 30 μm or less, a film thickness of said fired resistance body layer is 40 μm or less.

10. A chip resistor comprising:

metal wires formed on at least one face of a ceramic substrate and which is made of material selected from the group of copper-nickel and nickel-chromium;

a fired resistance body layer which is formed on said metal wires and which is made of at least copper-nickel;

a pair of terminal electrodes which are formed so as to cover at least parts of both end portions of said fired resistance body layer; and end-face electrodes which are formed on both side faces of said ceramic substrate so as to cover at least parts of both end portions of said terminal electrodes, wherein a diameter of sintered particles of said fired resistance body layer is 30 μm or less, a film thickness of said fired resistance body layer is 40 μm or less.

11. A chip resistor comprising:

metal foil which is formed on one face of a ceramic substrate, and which is made of material selected from the group of copper-nickel and nickel-chromium;

a fired resistance body layer which is formed on another face of said ceramic substrate, and which is made of at least copper-nickel;

a pair of terminal electrodes which are formed so as to cover at least parts of both end portions of said fired resistance body layer; and end-face electrodes which are formed on both side faces of said ceramic substrate so as to cover at least parts of both end portions of said terminal electrodes and parts of both end portions of said metal foil, wherein a diameter of sintered particles of said fired resistance body layer is 30 μm or less, a film thickness of said fired resistance body layer is 40 μm or less.

12. A chip resistor comprising:

metal wires which are formed on one face of a ceramic substrate, and which is made of material selected from the group of least copper-nickel and nickel-chromium;

fired resistance body layers which are formed on another face of said ceramic substrate and on upper faces of said metal wires, and which are made of at least copper-nickel;

terminal electrodes which are formed so as to cover at least parts of both end portions of said fired resistance body layers on both the faces; and end-face electrodes which are formed on both side faces of said ceramic substrate so as to cover at least parts of both end portions of said terminal electrodes, wherein a diameter of sintered particles of at least one of said two fired resistance body layers is 30 μm or less, a film thickness of said fired resistance body layer is 40 μm or less.

13. The chip resistor of claim 7, wherein said resistor is wholly covered by a resin except at least parts of said end-face electrodes.

14. The chip resistor of claim 8, wherein said resistor is wholly covered by a resin except at least parts of said end-face electrodes.

* * * * *

UNITED STATES PATENT AND TRADEMARK OFFICE

CERTIFICATE OF CORRECTION

PATENT NO. : 5,907,274

DATED : May 25, 1999

INVENTOR(S) : Kimura et al.

It is certified that error appears in the above-identified patent and that said Letters Patent is hereby corrected as shown below:

Column 7, Table 2, after line 10 in the body of the table which begins with "Upper Face", insert on a new line directly under "Upper Face" the word --Electrode--.

Column 17, Table 9, Column 3, Line 3, delete "Foil" and insert --Wire(s)--.

Column 18, Line 29, Claim 1, delete ";" and insert --,--

Column 18, Line 56, Claim 4, delete ";" and insert --,--

Column 19, Line 10, Claim 7, after "electrodes," begin a new subparagraph on the next line.

Signed and Sealed this

Twenty-third Day of November, 1999

*Attest:*

Q. TODD DICKINSON

*Attesting Officer*

*Acting Commissioner of Patents and Trademarks*